US007681640B2

(12) United States Patent
Bixenman et al.

(10) Patent No.: US 7,681,640 B2
(45) Date of Patent: Mar. 23, 2010

(54) SCREEN AND METHOD HAVING A PARTIAL SCREEN WRAP

(75) Inventors: Patrick W. Bixenman, Holywood (IE); Craig D. Johnson, Montgomery, TX (US); Jake A. Danos, Youngsville, LA (US); Matthew R. Hackworth, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 229 days.

(21) Appl. No.: 11/539,208

(22) Filed: Oct. 6, 2006

(65) Prior Publication Data

US 2007/0102153 A1 May 10, 2007

Related U.S. Application Data

(60) Division of application No. 10/905,229, filed on Dec. 22, 2004, now Pat. No. 7,131,494, which is a division of application No. 10/079,670, filed on Feb. 20, 2002, now Pat. No. 6,848,510, which is a continuation-in-part of application No. 09/779,861, filed on Feb. 8, 2001, now Pat. No. 6,575,245, and a continuation-in-part of application No. 10/021,724, filed on Dec. 12, 2001, now Pat. No. 6,695,054.

(60) Provisional application No. 60/261,752, filed on Jan. 16, 2001, provisional application No. 60/286,155, filed on Apr. 24, 2001, provisional application No. 60/296,042, filed on Jun. 5, 2001, provisional application No. 60/354,552, filed on Feb. 6, 2002.

(51) Int. Cl.
*E21B 43/04* (2006.01)
*E21B 43/26* (2006.01)
*E21B 47/00* (2006.01)

(52) U.S. Cl. ..... 166/250.01; 166/278; 166/305.1; 166/308.1

(58) Field of Classification Search ..... 166/278, 166/250.01, 227, 308.1, 305.1
See application file for complete search history.

(56) References Cited

U.S. PATENT DOCUMENTS 5,964,296 A * 10/1999 Ross ..... 166/373
6,554,064 B1 * 4/2003 Restarick et al. ..... 166/250.01
6,675,891 B2 * 1/2004 Hailey et al. ..... 166/228
6,684,951 B2 * 2/2004 Restarick et al. ..... 166/250.01
7,100,690 B2 * 9/2006 Mullen et al. ..... 166/278

* cited by examiner

*Primary Examiner*—Hoang Dang
(74) *Attorney, Agent, or Firm*—David Matthews; Jeremy P. Welch; Van Someren, PC

(57) ABSTRACT

The present invention provides a screen for a well that utilizes a partial screen wrapping used to advantage with side conduits (e.g., alternate flowpaths), control lines, intelligent completions devices, and the like. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

4 Claims, 9 Drawing Sheets

SCREEN AND METHOD HAVING A PARTIAL SCREEN WRAP

CROSS-REFERENCE TO RELATED APPLICATION

This is a divisional of U.S. Ser. No. 10/905,229, now U.S. Pat. No. 7,131,494, filed Dec. 22, 2004, which is a divisional of U.S. Ser. No. 10/079,670 U.S. Pat. No. 6,848,510 filed Feb. 20, 2002, which is a continuation-in-part of U.S. Ser. No. 09/779,861, now Pat. No. 6,575,245 filed Feb. 8, 2001 as well as U.S. Ser. No. 10/021,724, now U.S. Pat. No. 6,695,054, filed Dec. 12, 2001 (which claims priority to provisional patent application 60/261,752 filed Jan. 16, 2001, 60/286,155 filed Apr. 24, 2001 and 60/296,042 filed Jun. 5, 2001). The following is also based upon and claims priority to U.S. provisional application Ser. No. 60/354,552, filed Feb. 6, 2002.

FIELD OF THE INVENTION

The present invention relates to a well screen for use in a wellbore aspects relates to a well screen. More specifically, the present invention relates to a partial filter media used to advantage with side conduits (i.e., alternate flowpaths), control lines, and the like.

BACKGROUND OF THE INVENTION

It is common to place a sand screen in a well to filter solids from the production fluid (e.g., hydrocarbons, water). It is often desirable to route cables or side conduits adjacent the screens. For example, a side conduit, or shunt tube, may be used to improve a gravel pack in a well. As another example, a control line may be routed to bypass at least a portion of the sand screen. Likewise, it may be desirable to route other types of conduits, like chemical injection lines, to bypass at least a portion of the screen. It may also be desirable to mount other equipment (e.g., sensors) adjacent the screens. Many other such examples exist.

Typically, however, mounting a device (e.g., control line, side conduit, other equipment) adjacent the screen or inside the screen reduces the inside diameter of the screen. Mounting equipment inside the screen's base pipe may create other issues as well.

Accordingly, there exists a continuing need for a screen and related devices that maximizes the inner diameter of the screen while still allowing devices such as control lines, tubes, side conduits, and equipment to bypass the screen or mount adjacent the screen.

SUMMARY

In general, according to one embodiment, the present invention provides a partial filter media used to advantage with side conduits (i.e., alternate flowpaths), control lines, and the like. Other features and embodiments will become apparent from the following description, the drawings, and the claims.

DETAILED DESCRIPTION OF PREFERRED EMBODIMENTS

In the following description of the present invention, numerous details are set forth to provide an understanding of the present invention. However, it will be understood by those skilled in the art that the present invention may be practiced without these details and that numerous variations or modifications from the described embodiments may be possible.

In this description, the terms "up" and "down"; "upward" and downward"; "upstream" and "downstream"; and other like terms indicating relative positions above or below a given point or element are used in this description to more clearly described some embodiments of the invention. However, when applied to apparatus and methods for use in wells that are deviated or horizontal, such terms may refer to a left to right, right to left, or other relationship as appropriate.

Figure 1:
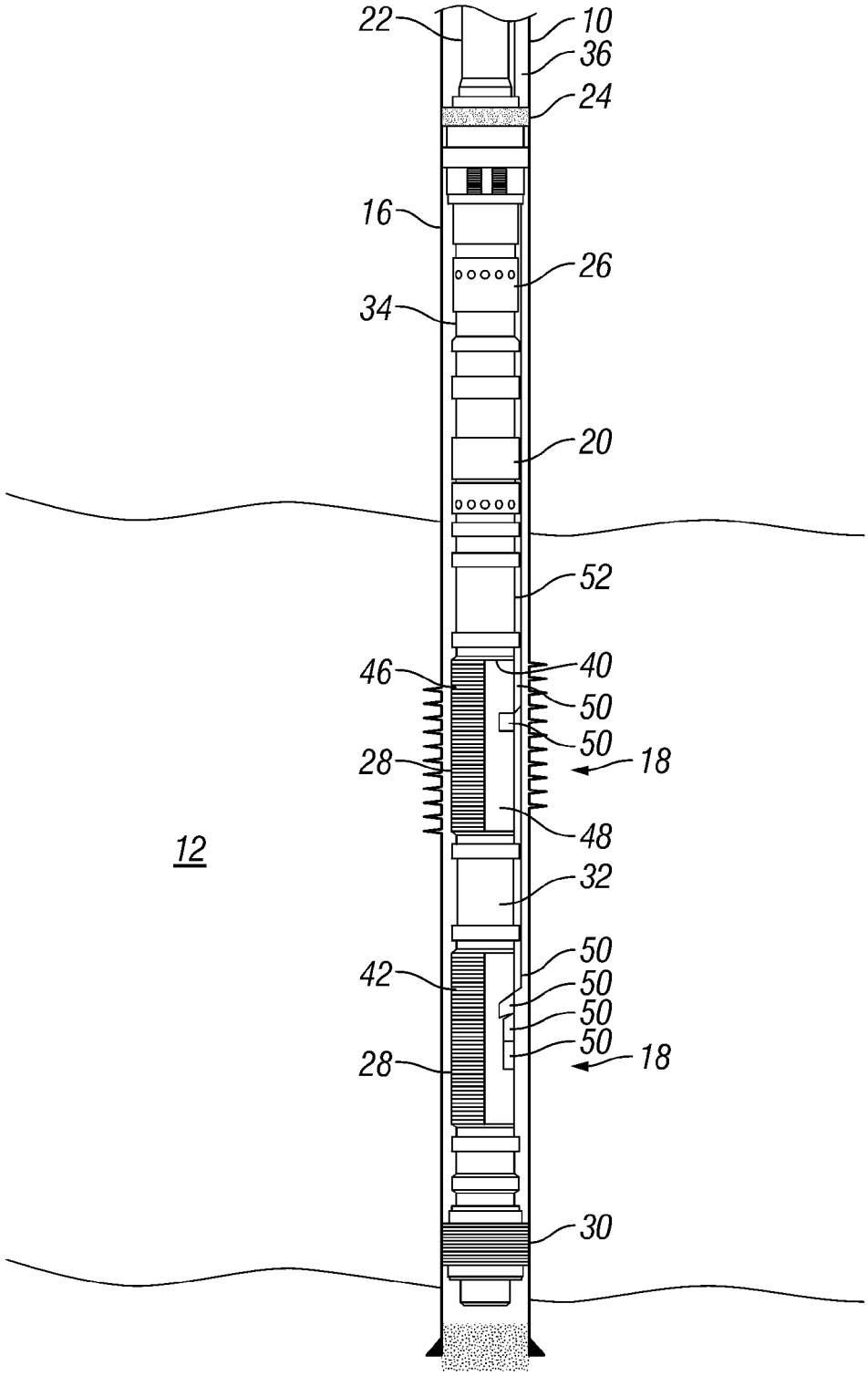
FIG. 1 is a illustrates a well having a screen with a partial screen wrapping and screen-adjacent devices placed therein.

FIG. 1 illustrates a typical gravel pack completion in which a wellbore 10 penetrates a subterranean zone 12 that includes a productive formation. The wellbore 10 has a casing 16 that has been cemented in place. The casing 16 has a plurality of perforations 18 which allow fluid communication between the wellbore 10 and the productive formation 14. A well tool 20 is positioned within the casing 16 in a position adjacent productive formation 14, which is to be gravel packed.

The well tool 20 comprises a tubular member 22 attached to a production packer 24, a cross-over 26, one or more screens 28 and optionally a lower packer 30. Blank sections 32 of pipe may be used to properly space the relative positions of each of the components. An annulus area 34 is created between each of the components and the wellbore casing 16.

In a typical gravel pack operation the packer elements 24, 30 are set to ensure a seal between the tubular member 22 and the casing 16. Gravel laden slurry is pumped down the tubular member 22, exits the tubular member through ports in the cross-over 26 and enters the annulus area 34. Slurry dehydration occurs when the carrier fluid leaves the slurry. One way the carrier fluid can leave the slurry is by way of the perforations 18 and entering into the formation 14. The carrier fluid can also leave the slurry by way of the screen 28 and entering the tubular member 22. The carrier fluid entering through the screen 28 flows up through the tubular member 22 until the cross-over 26 places it into the annulus area 36 above the production packer 24, where it can be circulated to the surface. With proper slurry dehydration the gravel grains should be deposited within the annulus area 34 and pack tightly together. Note that there are many processes used to provide a gravel pack in a well and the above description is but one example.

As used herein, the term "screen" refers to wire wrapped screens, mechanical type screens and other filtering mechanisms typically employed with sand screens. Screens generally have a perforated base pipe with a filter media (e.g., wire wrapping, mesh material, pre-packs, multiple layers, woven mesh, sintered mesh, foil material, wrap-around slotted sheet, wrap-around perforated sheet, or a combination of any of these media to create a composite filter media and the like) disposed thereon to provide the necessary filtering. The filter media may be made in any known manner (e.g., laser cutting, water jet cutting and many other methods). Sand screens need to have openings small enough to restrict gravel flow, often having gaps in the 60-120 mesh range, but other sizes may be used. The screen element 28 can be referred to as a screen, sand screen, or a gravel pack screen. Many of the common screen types include a spacer that offsets the screen from a perforated base tubular that the screen surrounds. The spacer provides a fluid flow annulus between the screen and the base tubular. Screens of various types commonly known to those skilled in the art. Note that other types of screens will be discussed in the following description. Also, it is understood that the use of other types of base pipes, e.g. slotted pipe, remains within the scope of the present invention.

Figure 2:
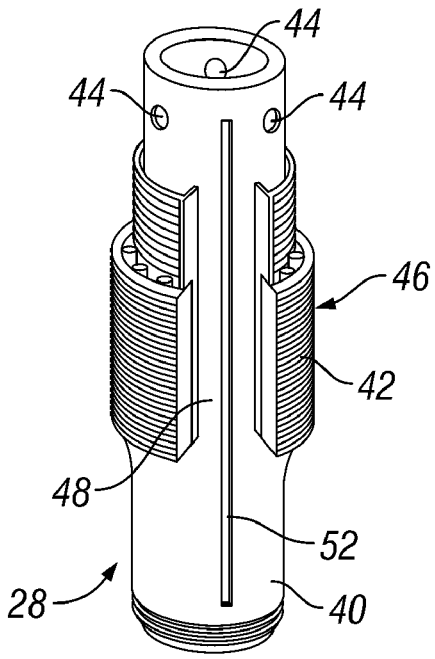
FIGS. 2 through 5 illustrate various embodiments of the screen of the present invention.

However, as shown in FIG. 1, the sand screens of the present invention have a first portion 46 that has a filter media 42 thereon and a second portion 48 that does not have a filter media thereon. Thus, the filter media 42 is provided around a portion of the circumference of the base pipe 40 only as shown in the figures. Thus, in the embodiment of the present invention shown, the base tubular, or base pipe, 40 comprises apertures 44 located within a certain radial arc. A screen element, or filter media, 42 is attached to the exterior of the base tubular 40 and covers the apertures 44 (FIG. 2). The portion of the base tubular containing apertures is referred to as the first portion, or radial aperture zone, 46. The portion of the base tubular 40 not containing apertures is referred to as the second portion, or radial blank zone, 48.

As shown in FIG. 1, one or more adjacent-screen devices 50 are placed radially adjacent to the second portion of the screen 28. Placing the adjacent-screen devices 50 radially adjacent to the second portion of the screen 28 increases the inner diameter of the screen 28 by reducing the overall outer profile of the screen 28. Note that the outer diameter of the screen 28 is limited by the inner diameter of the casing 16 and other considerations.

As used herein, the general term adjacent-screen device 50 shall be used to refer generally to equipment placed in the well that is radially adjacent to a screen. For example, adjacent screen devices may comprise control lines and cables, side conduits (e.g., shunt tubes, chemical injection lines, fluid conduits, hydraulic control lines), intelligent completion devices, (e.g., sensors) and other equipment. Examples of control lines 52 are electrical, hydraulic, fiber optic lines and combinations of thereof. Note that the communication provided by the control lines 52 may be with downhole controllers rather than with the surface and the telemetry may include wireless devices and other telemetry devices such as inductive couplers and acoustic devices.

Examples of intelligent completions devices 54 are gauges, sensors, valves, sampling devices, a device used in intelligent or smart well completion, temperature sensors, pressure sensors, flow-control devices, flow rate measurement devices, oil/water/gas ratio measurement devices, scale detectors, actuators, equipment sensors (e.g., vibration sensors), sand detection sensors, water detection sensors, data recorders, viscosity sensors, density sensors, bubble point sensors, pH meters, multiphase flow meters, acoustic sand detectors, solid detectors, composition sensors, resistivity array devices and sensors, acoustic devices and sensors, other telemetry devices, near infrared sensors, gamma ray detectors, $H_2S$ detectors, $CO_2$ detectors, downhole memory units, downhole controllers, perforating devices, shape charges, locators, and other downhole devices. In addition, the control line itself may comprise an intelligent completions device as in the example of a fiber optic line that provides functionality, such as temperature measurement, pressure measurement, sand detection, phase measurement, oil-water content measurement, seismic measurement, and the like. In one example, the fiber optic line provides a distributed temperature functionality (or distributed temperature sensor) so that the temperature along the length of the fiber optic line may be determined.

FIG. 2 illustrates one embodiment of the present invention in which the filter media 42 comprises multiple layers. The figure shows a control line 52 extending through the second portion 48 of the screen 28. In one embodiment, the screen 28 is made by cutting along the longitudinal wire to which the wrapped wire (for example) of the filter media 42 is welded. This cut is made on such that the longitudinal wire remains with the screen section to be used in the screen 28. Two boss rings are then cut to provide the same gap as in the cut screen. The boss rings are then welded to each end of the screen with the cutaway section of ring oriented with that of the screen. A base pipe 40 is selectively perforated such that the portion of the base pipe 40 corresponding to the second portion 48 remains unperforated and the screen section is positioned on the base pipe 40 so that the cutaway section is aligned with the unperforated portion of the base pipe. The screen section and boss members are then welded to the base pipe 40 so that the unperforated section and the cutaway sections define the second portion 48 of the screen 28.

Figure 3:
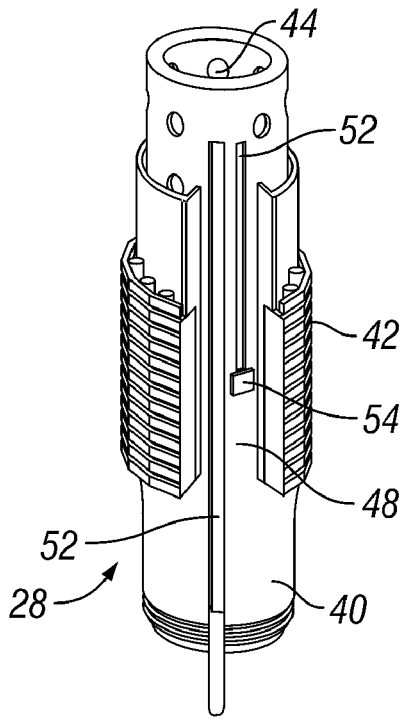

FIG. 3 illustrates another embodiment in which the filter media 42 comprises an inner mesh layer and an outer wire wrap layer. The figure also shows a control line 52 extending through the second portion 48 of the screen 28 as well as an intelligent completions device (e.g., a sensor) 54 placed in the second portion 48. The intelligent completions device 54 has a control line 52 extending therefrom that is also positioned in the second portion 48. In one embodiment, the screen 28 is made in a manner similar to that of the screen of FIG. 2. Note that the mesh material may be provided in a predetermined width so that the material does not require cutting to define a cut-away portion for the second portion 48.

Figure 4:
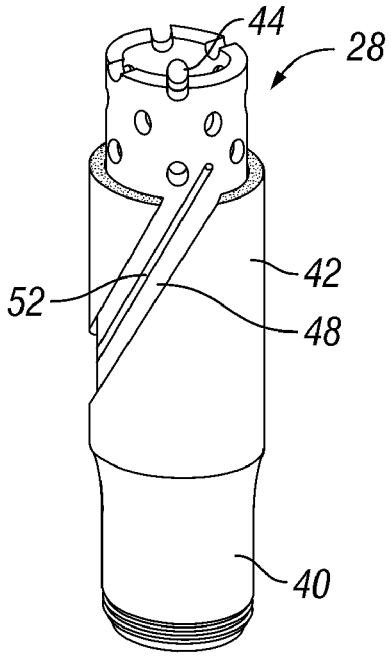

FIG. 4 illustrates another embodiment in which the filter media 42 is a mesh material. The second portion 48 extends along a helical path and has a control line 52 positioned therein. Accordingly, FIG. 4 illustrates that the second portion 48 may follow a path other than a linear path along the screen 28. Thus, the path of the second portion 48 along the screen 28 may be arcuate. In one embodiment, the screen is manufactured by cutting the filter media 42 to define the helical (or arcuate) path and attaching the filter media to the base pipe 40 with the arcuate path aligned with an unperforated section of the base pipe 40 to define the second portion 48.

Figure 5:
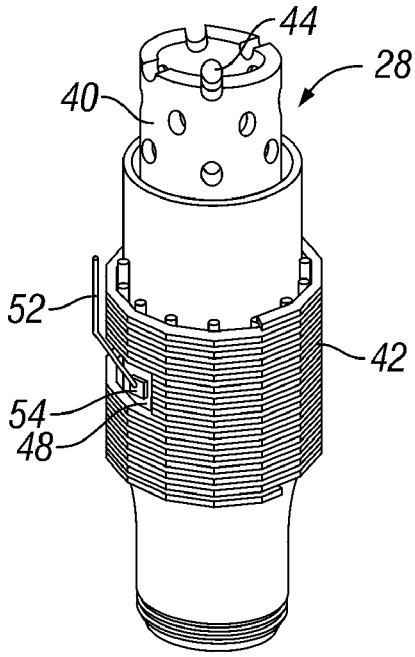

In FIG. 5, the second portion 48 does not extend the length of the screen 28. Instead, the second portion 48 is in the form of a cut-out. An intelligent completions device 54 is placed in the cut-out second portion 48. In the illustration, a control line 52 extends from the intelligent completions device 54 outside of the second portion 48 (adjacent the first portion 46).

Figure 6:
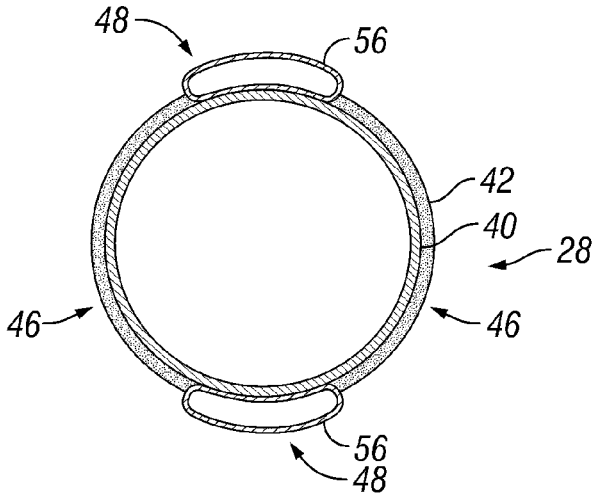
FIGS. 6 through 17 are cross-sectional views of various embodiments of the screen of the present invention.

Referring to FIG. 6, an embodiment of the screen 28 is illustrated in cross-section. As in the previously described embodiments, the filter media 42 is provided around a portion of the circumference of the base pipe 40. The screen material 42 extends about a portion of the circumference of the base pipe 40 to define the first portion 46 of the circumference that is covered by the screen material 42 and the second portion 48 of the circumference that is not covered by the screen material 42. As shown in the figures there may be one or any number of second, unwrapped portions 48 (as well as first portions 46).

One or more side conduits, or shunt tubes, 56 (two shown) are affixed directly onto or adjacent the base pipe 40 in the second portion 48 and extend longitudinally along the length of the base pipe 40 (or at least a portion of the length thereof). The side conduits 56 are shown as having an elliptical cross-section, but other cross-sections (e.g. rectangular) may be used with the present invention.

Figure 7:
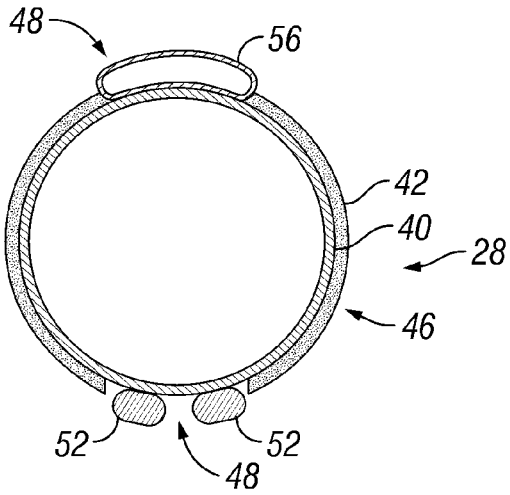

An example of an embodiment of the screen 28 used with a control line 52 is shown in FIG. 7. In the illustrated embodiment, both a side conduit 56 and two control lines 52 are affixed, or adjacent, to the base pipe 40. In this embodiment, the control line 52 comprises an intelligent completions device 50.

Figure 8:
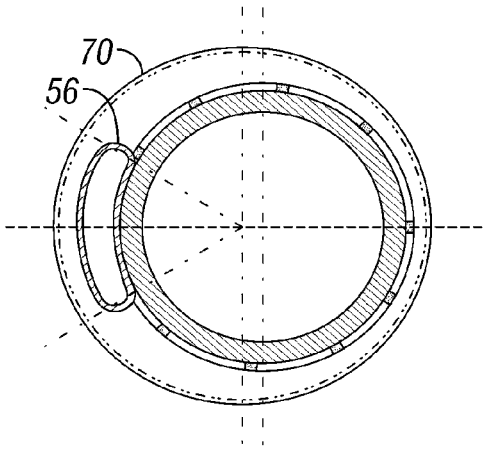

FIG. 8 shows another embodiment of the invention in which the screen 28 has a side conduit 56 mounted in the second portion 48 thereof. A shroud 70 surrounds the screen 28 providing protection for the screen 28 and side conduit 56. In the embodiment shown, the shroud 70 is eccentrically mounted with respect to the screen 28.

Figure 9:
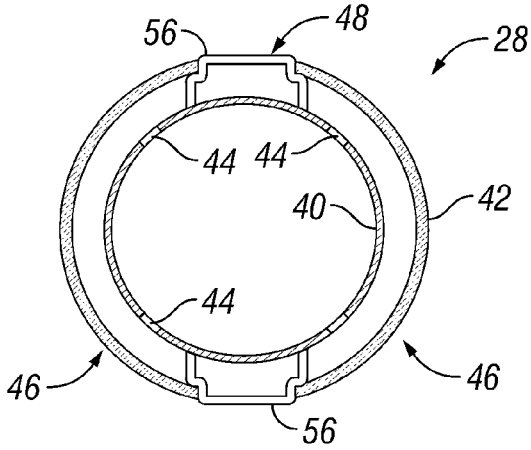
Figure 10:
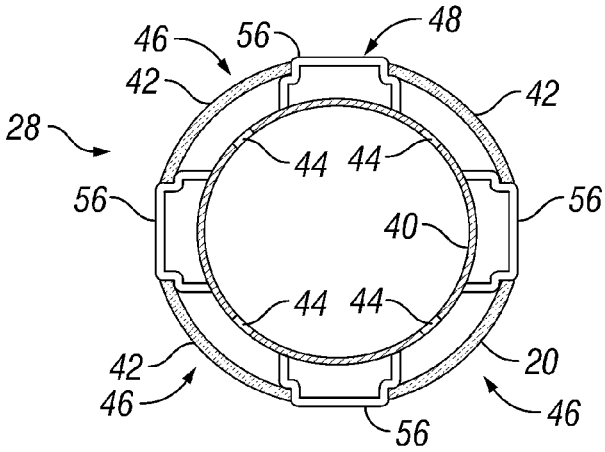

FIG. 9 shows another exemplary embodiment in which the one wall of the side conduits 56 is formed by the base pipe itself by welding a unshaped member to the base pipe. In the embodiment of this figure, the screen material is then connected to the side conduit 56 (at its outer diameter as measured from the center of the base pipe). FIG. 9 illustrates two such side conduits 56. FIG. 10 is similar to FIG. 9, but shows four such side conduits. In one embodiment, the screen 28 is manufactured by selectively perforating a base pipe 40 and connecting the side conduits 56 to the unperforated portion thereof to form a first assembly. A filter media 42 is laser cut or water jet cut to the desired filtering specification and size and is connected to the first assembly.

Figure 11:
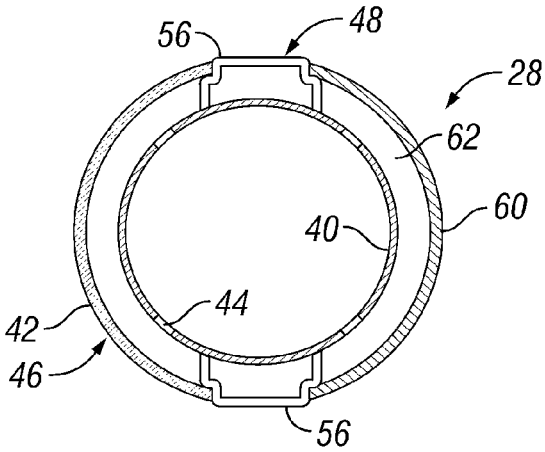

FIG. 11 illustrates an alternative embodiment in which an outer member 60 is mounted to the base pipe 40 (as by attaching the outer member 60 to the side conduits 56). The outer member 60 and the base pipe 40 define a side passageway 62 therebetween which may be used to transport fluids, solids (e.g., sand), slurries and other materials. Note that the outer member 60 surrounds an unperforated portion of the base pipe 40 (a second portion 48).

Figure 12:
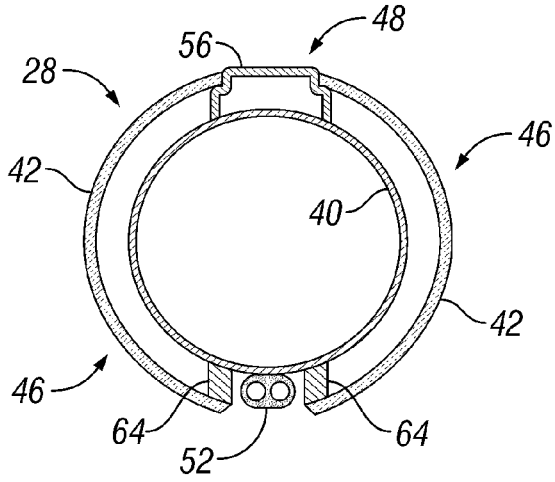

FIG. 12 illustrates yet another embodiment similar to FIG. 9. In this embodiment, the filter media 42 is connected to the side conduit 56 on one end and spacing members 64 on the other end. The spacing members 64 may also provide protection for the control line 40 and may have the associated and required strength to provide such protection. Note that the base pipe 40 in FIG. 12 is unperforated about its full circumference in the cross section shown. Thus, in this embodiment, the flow may be directed to another perforated area of the screen, to a valve, to pressure equalizing equipment (e.g., a tortuous path), or to other equipment through the annulus between the filter media 42 and the base pipe 40 as desired.

Figure 13:
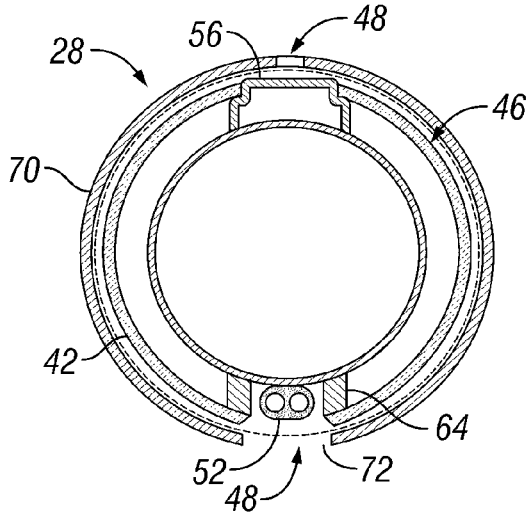

FIG. 13 discloses another embodiment similar to that shown in FIG. 12, but further including a protective shroud 70. In the embodiment shown, the shroud 70 has an optional side opening 72 that facilitates placement of the control line in the second portion 24.

Figure 14:
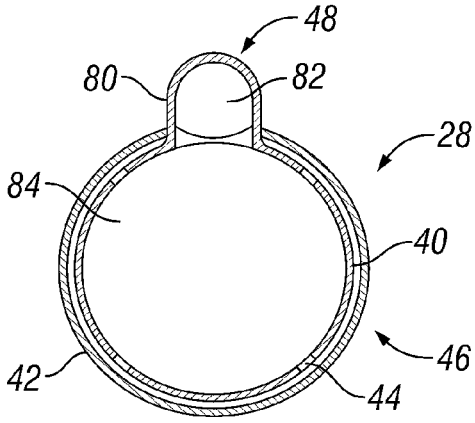

In FIG. 14, the base pipe 40 includes a side pocket 82 and comprises a side pocket mandrel 80. The side pocket mandrel 80 has a conventional design in that it has a main bore 84 and a side pocket 82 and is capable of receiving a device, such as an adjacent-screen device 50 in the side pocket 82. A filter media 42 extends about a portion of the side pocket mandrel 80. For example, the filter media 42 may extend about the portion of the side pocket mandrel 80 defining the main bore 84 and attach to the portion of the side pocket mandrel 80 surrounding the side bore 82 (as shown in the figure). The portion covered by the filter media 42 is perforated and represents the first portion 46 of the screen 28.

Figure 15:
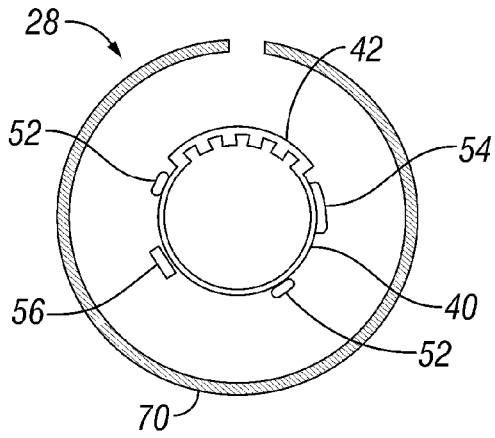

FIG. 15 shows another embodiments of the screen 28 having a protective shroud 70. The figure illustrates a sand screen 28 in which the second portion 48 of the screen 28 covers a greater portion of the circumference (arc) than the first portion 46. The figure shows a number of adjacent-screen devices 50 in the second portion 48. The large arc of the second portion 48 facilitates the placement of numerous adjacent-screen devices 50 as well as alignment of control lines 52 and side conduits 56 with other equipment. The figure shows a number of control lines 52, a side conduit 56, and an intelligent completions device 54 in the second portion.

Figure 16:
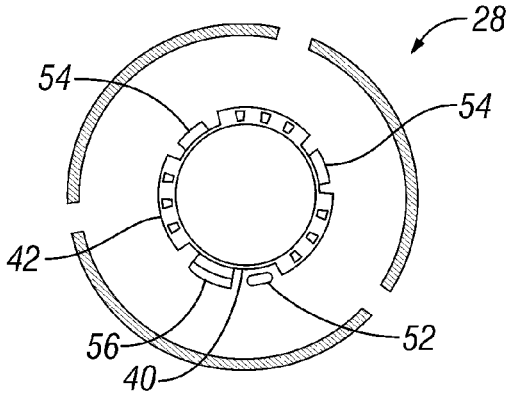

FIG. 16 shows a screen 28 having three first and second portions 46,48 with adjacent-screen devices 50 mounted in the second portions.

Figure 17:
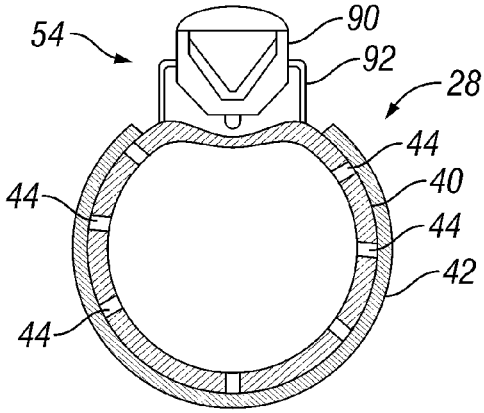

FIG. 17 illustrates an alternative embodiment of the present invention in which the adjacent-screen device 50 mounted in the second portion 48 is a shape charge 90. A clip 92 holds the shape charge 90 to the base pipe 40. Note that with a helical or other pattern of the second portion 48 along the length of the screen 28 a plurality of shaped charges can provide a spiral or other shot pattern. In this manner the shape charges are provided on the screen 28 and the well may be perforated and then gravel packed without moving the completion in a single trip into the well. Methods and devices for detonating the shape charges 90 are well known.

In another embodiment of the present invention, the screen 28 is of the expandable type. Expandable screens generally have an expandable base pipe 100, an expandable shroud, or protective tube, 102, and a filter media 104 of one or more layers interposed therebetween that can expand without losing its expanding characteristics. It should be noted that many types of expandable tubes are available. As examples, the expandable tubing may be a solid expandable tubing, a slotted expandable tubing (or other types wherein the structure is weakened by perforating the base pipe, as with holes), or any other type of expandable conduit. Examples of expandable tubing are the expandable slotted liner type disclosed in U.S. Pat. No. 5,366,012, issued Nov. 22, 1994 to Lohbeck, the folded tubing types of U.S. Pat. No. 3,489,220, issued Jan. 13, 1970 to Kinley, U.S. Pat. No. 5,337,823, issued Aug. 16, 1994 to Nobileau, U.S. Pat. No. 3,203,451, issued Aug. 31, 1965 to Vincent, the expandable sand screens disclosed in U.S. Pat. No. 5,901,789, issued May 11, 1999 to Donnelly et al., U.S. Pat. No. 6,263,966, issued Jul. 24, 2001 to Haut et al., PCT Application No. WO 01/20125 A1, published Mar. 22, 2001, U.S. Pat. No. 6,263,972, issued Jul. 24, 2001 to Richard et al., as well as the bi-stable cell type expandable tubing disclosed in U.S. patent application Ser. No. 09/973,442, filed Oct. 9, 2001. Each length of expandable tubing may be a single joint or multiple joints.

Figure 18:
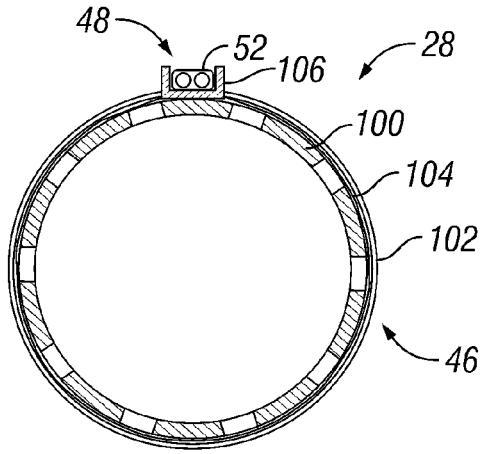
FIGS. 18 through 24 are cross-sectional views of various embodiments of the expandable screen of the present invention.

FIG. 18 discloses one embodiment of the present invention comprising an expandable base pipe 100, an expandable shroud 102 and a filter media 104. In the embodiment shown, the filter media 104 is a series of scaled filter sheets. The screen 28 has a first portion 46 that has a filter media 104 thereon and a second portion 48 that does not have a filter media thereon. A protective member 106 is provided on the second portion 48 and an adjacent screen device 50 (e.g., a control line 52) is placed therein. The protective member 106 may take the form, as an example, of a channel that extends the length of the screen 28. In another embodiment, the protective member 106 extends only a portion of the full length of the screen 28 or comprises multiple devices spaced along the length of the screen 28. The protective member may be attached to the expandable base pipe 100, the expandable shroud 102, or formed as an integral part of one or more of these elements.

Figure 19:
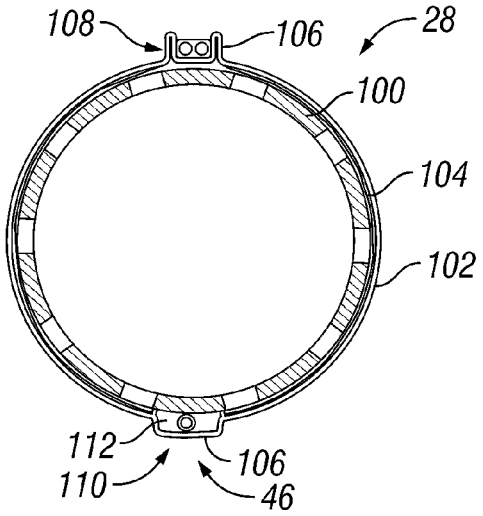

In FIG. 19, the protective member 106 is formed as part of the expandable shroud 102. In the embodiment shown, the shroud 102 forms two protective members 106. A first protective member 108 is in the form of a channel. Although not shown, the filter media 104 could pass beneath the shroud channel. A second protective member 110 forms an internal cavity 112 through which a control line 52 may pass or an intelligent completions device 54 may reside. In an alternative embodiment, the internal cavity 112 may itself comprise a side conduit 56.

Figure 20:
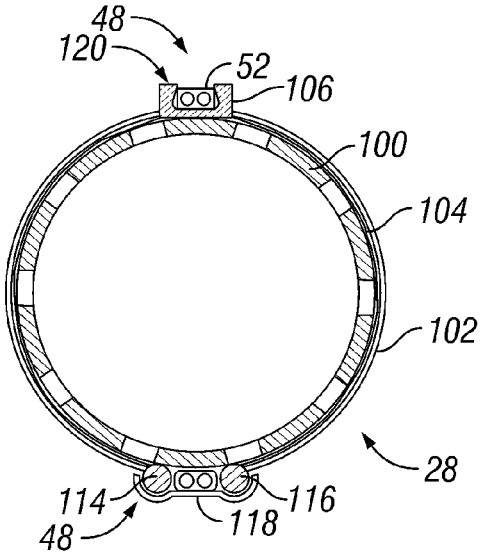

FIG. 20 shows another embodiment of the present invention illustrating two additional alternative protective members 106. The first protective member 114 shown comprises a pair of parallel bars 116 mounted to the expandable base pipe 100 and the expandable shroud 102 on either side of the second portion 48. The bars 116 extend longitudinally along the screen 28. A clip 118 is then locked to the two bars 116 to secure the control line 52 in place.

The second protective member 120 shown in FIG. 20 is a channel. The channel 120 has a dovetail groove forming a mouth with a smaller width than the inner portion of the channel 120. In this embodiment, the control line 52 is non-circular and capable of fitting through the mouth in one orientation after which it is reoriented so that it cannot pass through the mouth. Thereby the control line 52 is held in the channel 120.

Figure 21:
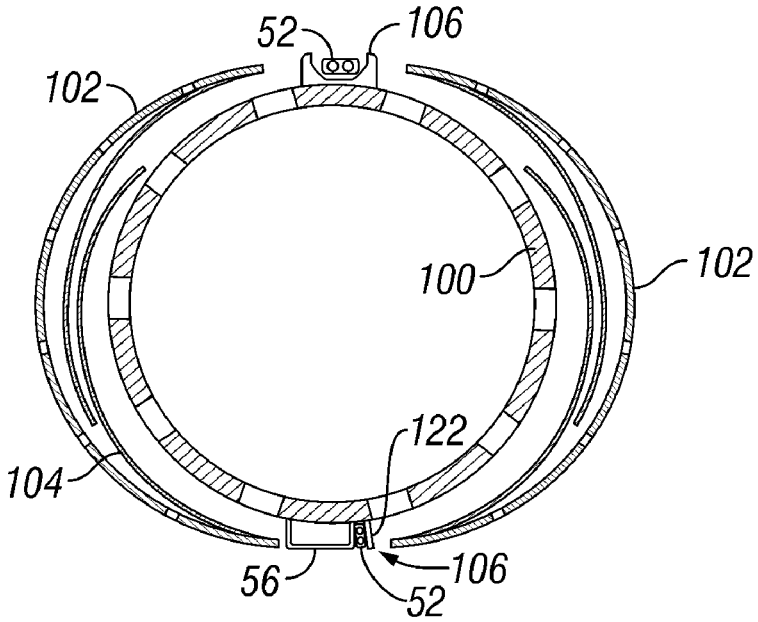

FIG. 21 illustrates one possible technique for manufacturing a screen 28 of the present invention. One or more protective members 106 are mounted to the base pipe 100. In the illustration, one of the protective members 106 is a channel attached to the base pipe 100. A control line 52 is placed in the channel. A clip (not shown) may be used to maintain the control line 52 in the channel. The other illustrated protective members 106 comprises a side conduit 56 mounted to the expandable base pipe 100 and a protruding member 122 spaced therefrom and also mounted to the base pipe 100. A control line 52 may be placed in the space between the side conduit 56 and the protruding member 122. The filter media 104 are attached to shroud sections 102 (although they may also be connected to the base pipe 100). The filter media 104 is provided in sheets that are arranged in an overlapping fashion so that the sheets slide over one another during expansion.

The side conduit 56 of the expanding embodiment of the screen 28 may be used, for example, to deliver chemicals to the well (chemical injection line), to deliver fluids to below the screen 28, to gravel pack areas around the screen 28 that are not fully expanded or where there is an annulus, to deliver fracturing fluids, or for other purposes. Thus, the method would be to place the expandable screen 28 having a side conduit 56 attached thereto into the well, expand the expandable screen, and deliver a fluid through the side conduit 56 to complete the desired operation.

Figure 22:
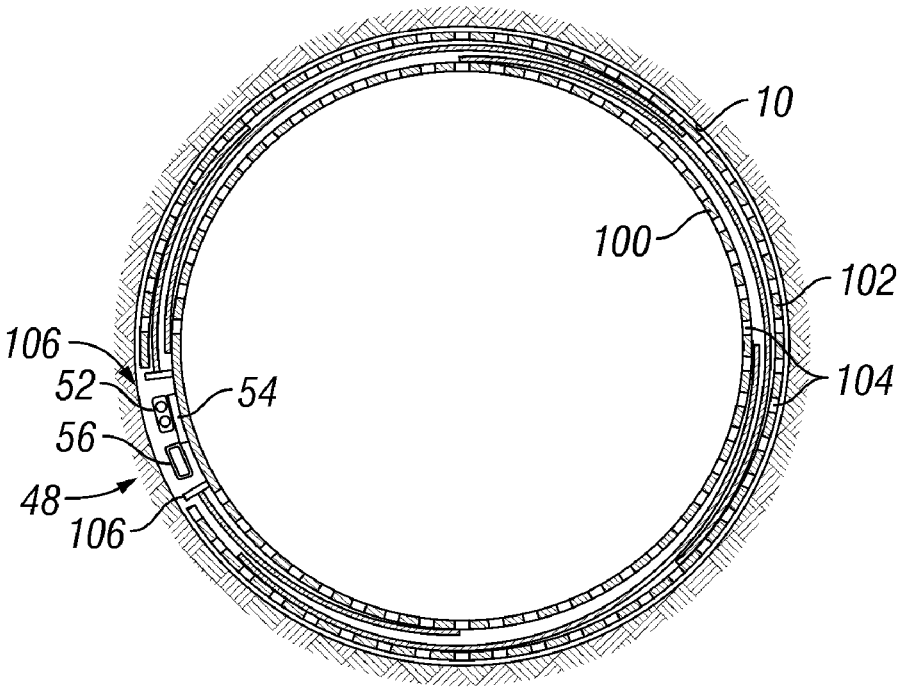

FIG. 22 illustrates another embodiment of the present invention expanded in a wellbore 10. The screen 28 has an expandable base pipe 100, an expandable shroud 102, and a series of scaled filter sheets therebetween providing the filter media 104. Some of the filter sheets are connected to the protective member 106. The figure shows, for illustration purposes, a control line 52, an intelligent completions device 54, and a side conduit 56 positioned within the second portion 48 of the screen 28.

Figure 23:
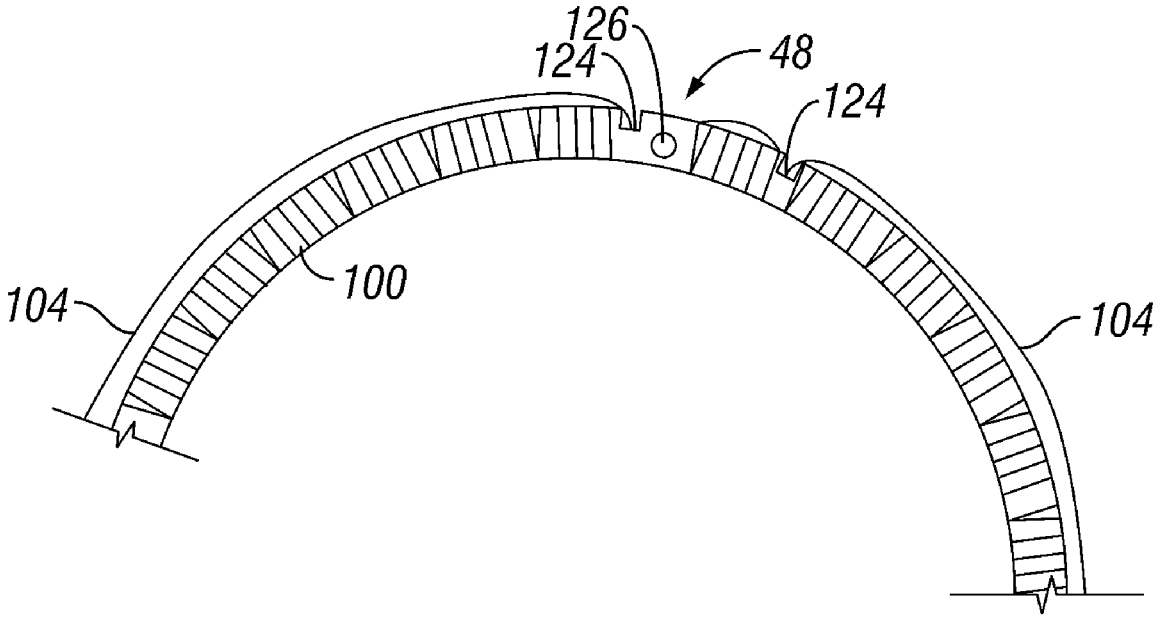
Figure 24:
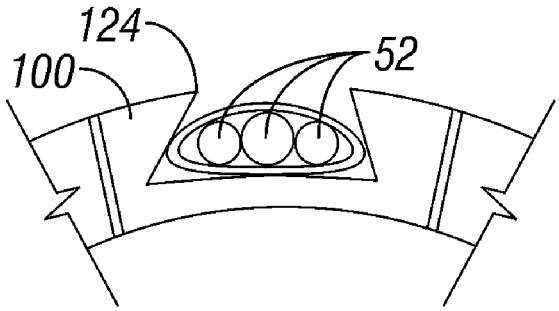

FIG. 23 illustrates another embodiment of the present invention in which the expandable base pipe 100 has a relatively wider unexpanding portion (e.g., a relatively wider thick strut in a bistable cell) that defines the second portion 48. The screen 28 does not have a shroud, although one may be included as previously discussed. One or more grooves 124 extend the length of the screen 28. An adjacent-screen device 50 may be placed in the groove 124 or other area of the second portion 48. Additionally, the base pipe 100 may form a longitudinal passageway 126 therethrough that may comprise or in which an adjacent-screen device 50 may be placed. FIG. 24 shows a groove 124 in the expandable base pipe 100 that has a dovetail design as previously described. Note that, although the grooves and passageways are described as formed in the expandable base pipe 100, they may also be formed in a shroud 102 of the screen 28.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method for completing a well, comprising:

positioning a completion string in the well, the completion string having a screen therein, the screen defining a first portion of a base tubular having radial apertures covered by a filter media and a second portion of the base tubular that is uncovered by the filter media and solid to prevent radial flow of fluid through the second portion, the second portion running the entire length of the screen;

providing a screen-adjacent device in the second portion of the screen; and performing a well operation while using the screen-adjacent device to measure a parameter along the length of the second portion.

2. The method of claim 1 wherein the well operation is a gravel packing operation.

3. The method of claim 1 wherein the well operation is a fracturing operation.

4. The method of claim 1 wherein the well operation is a treatment operation.

* * * * *